US005821196A

United States Patent [19]

Schulz et al.

[11] Patent Number: 5,821,196

[45] Date of Patent: Oct. 13, 1998

[54] THERMALLY-RESPONSIVE RECORD MATERIAL

[75] Inventors: Mary Ellen Schulz, Greenville; Michael Gerald Cove, Neenah, both of Wis.

[73] Assignee: Appleton Papers Inc., Appleton, Wis.

[21] Appl. No.: 835,701

[22] Filed: Apr. 10, 1997

[51] Int. Cl.[6] ..... B41M 5/30

[52] U.S. Cl. ..... 503/207; 427/150; 427/151; 503/208; 503/209

[58] Field of Search ..... 427/150–152; 106/31.16; 503/207, 208, 209, 216, 217, 221, 225

[56] References Cited

U.S. PATENT DOCUMENTS

| | | | |
|---|---|---|---|
| 4,364,999 | 12/1982 | Motohashi et al. | 428/411 |
| 4,426,424 | 1/1984 | Arai et al. | 428/411 |
| 4,431,706 | 2/1984 | Sato | 428/537 |
| 4,507,671 | 3/1985 | Koike et al. | 346/216 |
| 4,587,537 | 5/1986 | Miyauchi et al. | 346/208 |
| 4,617,582 | 10/1986 | Miyauchi et al. | 346/208 |
| 4,742,042 | 5/1988 | Hiraishi et al. | 503/201 |
| 4,861,748 | 8/1989 | Saeki et al. | 503/208 |
| 4,874,740 | 10/1989 | Hiraishi et al. | 503/201 |
| 4,888,321 | 12/1989 | Kawakami et al. | 503/208 |
| 4,956,333 | 9/1990 | Kawahara et al. | 503/209 |
| 5,008,231 | 4/1991 | Yoshizawa et al. | 503/207 |
| 5,043,312 | 8/1991 | Hiraishi et al. | 503/208 |
| 5,116,803 | 5/1992 | Hotta et al. | 503/208 |
| 5,118,656 | 6/1992 | Minami et al. | 503/209 |

*Primary Examiner*—Bruce H. Hess
*Attorney, Agent, or Firm*—Benjamin Mieliulis

[57] ABSTRACT

A novel thermally responsive record material is disclosed, comprising support having provided thereon in substantially contiguous relationship with electron donating dye precursor, an acidic developer material, a sensitizer, and a binder therefor. The sensitizer comprises at least two components, the first component comprising 2,2-bis(4-hydroxyphenyl)-4-methylpentane and the second component comprising a mixture of dimethyl terephthalate and 1,2-diphenoxyethane, the first component being in a range of weight ratios from 1:2 to 2:1 relative the second component, said second component comprising from 50 to 70% dimethyl terephthalate. The sensitizer is prepared by admixing the first component and the second component and grinding the sensitizer to a particle size of less than 1 micron.

11 Claims, 4 Drawing Sheets

Thermal Sensitivity

Thermal Sensitivity

Thermal Sensitivity

Thermal Sensitivity

THERMALLY-RESPONSIVE RECORD MATERIAL

FIELD OF THE INVENTION

This invention relates to thermally-responsive record material. It more particularly relates to such record material. It more particularly relates to such record material in the form of sheets coated with color-forming systems comprising chromogenic material (electron-donating dye precursors) and acidic color developer material. This invention particularly concerns a thermally-responsive record material capable of forming a non-reversible image resistant to face or erasure due to contact with oils, solvents or exposure to elevated temperature. The invention teaches a record material having improved image density retention.

DESCRIPTION OF RELATED ART

Thermally-responsive record material systems are well known in the art and are described in many patents, for example, U.S. Pat. Nos. 3,539,375; 3,674,535; 3,746,675; 4,151,748; 4,181,771; 4,246,318; 4,470,057 which are incorporated herein by reference. In these systems, basic chromogenic material and acidic color developer material are contained in a coating on a substrate which, when heated to a suitable temperature, melts or softens to permit said materials to react, thereby producing a colored mark.

Thermally-responsive record materials have characteristic thermal responses, desirably producing a colored image of sufficient intensity upon selective thermal exposure.

Thermally-responsive record materials in certain environments and applications have the undesirable tendency upon forming an image to not retain that image in its original integrity over time when the thermally-responsive record material is handled or exposed to common liquids or oils or plasticizers such as found in skin oil, plastic food wrap, cooking oil and solvents such as common carbonless paper solvents. Resistance to fade or more intense imaging is desirable.

The ability of a thermally-responsive record material to resist image fading or erasure upon contact with common oils, solvents or plasticizers or to have improved image density or faster imaging would be an advance in the art and of commercial significance.

It is an object of the present invention to disclose a thermally-responsive record material having improved image density and/or faster imaging.

It is an object of the present invention to disclose a thermally-responsive recording material comprising a support member bearing a thermally-sensitive color forming composition comprising chromogenic material and acidic developer material in substantially contiguous relationship, whereby the melting or sublimation of either material produces a change in color by reaction between the two, and a suitable binder therefor.

DETAILED DESCRIPTION OF THE PREFERRED EMBODIMENTS

Figure 1:
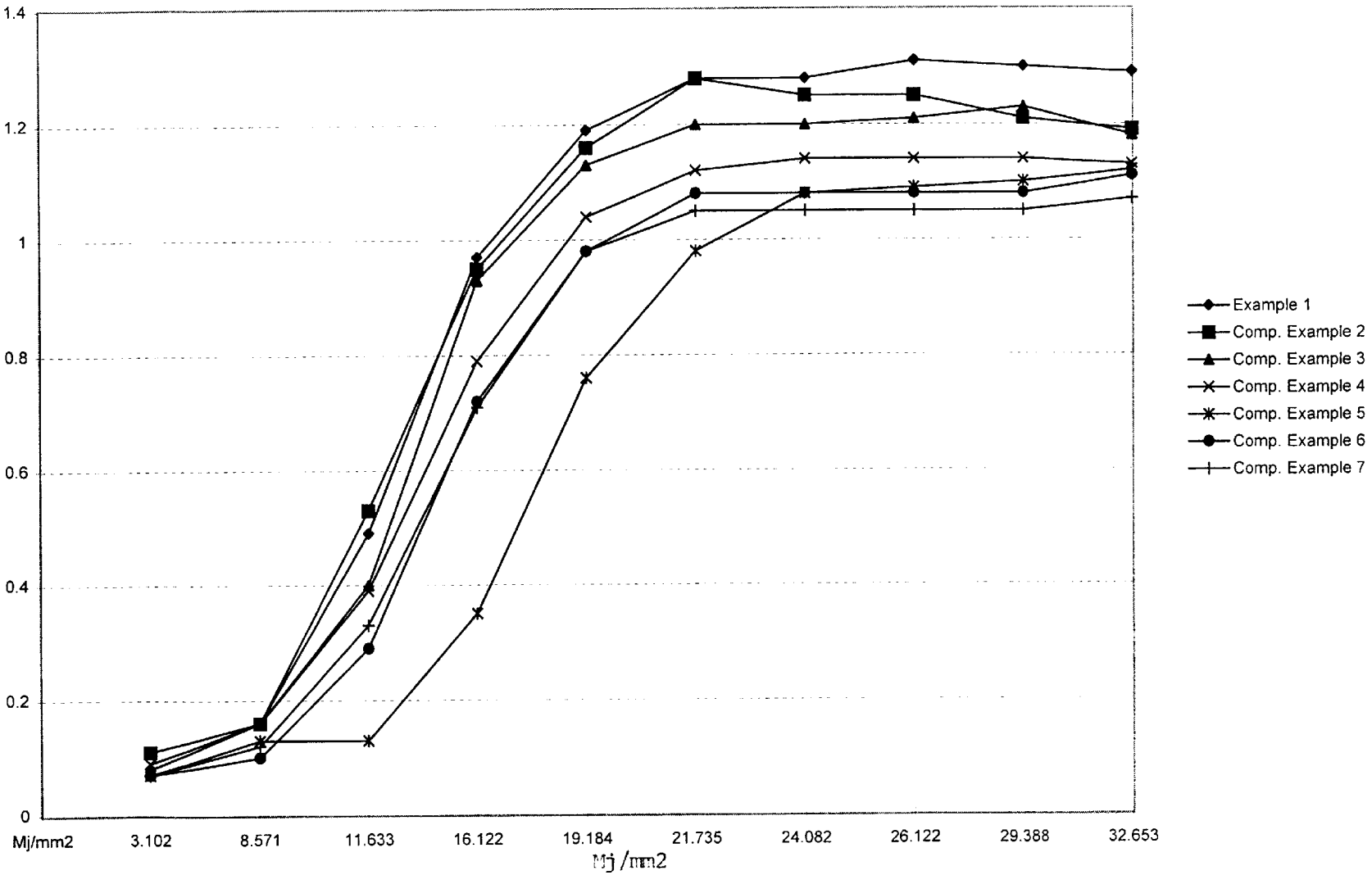
FIG. 1 illustrates the thermal response of the thermally responsive record material of the invention wherein components are ground together compared with comparative examples 2, 3, 4, 5, 6 and 7 wherein the components are ground separately.

The present invention is a thermally responsive record material comprising a support having provided thereon in substantially contiguous relationship an electron donating dye precursor, an acidic developer material, a sensitizer, and a binder therefor, the sensitizer comprising at least two components. The first component comprises 2,2-bis(4-hydroxyphenyl)-4-methylpentane (AP5) and the second component comprises a mixture of dimethyl terephthalate (DMT) and 1,2-diphenoxyethane (DPE), said second component comprising from 50 to 70% dimethyl terephthalate, the sensitizer prepared by admixing the first component and the second component and grinding the sensitizer to a particle size of less than 1 micron.

The invention is an improved thermally responsive record material of the type comprising a support having provided thereon in substantially contiguous relationship an electron donating dye precursor, an acidic developer material, and a binder therefor, wherein the improvement comprises including in addition a sensitizer prepared by admixing a first component and a second component and grinding the admixture to a particle size of less than 1 micron, the first component comprising 2,2-bis(4-hydroxyphenyl)-4-methylpentane and the second component comprising a mixture of dimethyl terephthalate and 1,2-diphenoxyethane, preferably the first component being in a range of weight ratios from 1:2 to 2:1 relative the second component, said second component comprising from 50 to 70% dimethyl terephthalate.

The invention also teaches a process for forming an improved sensitizer for thermally responsive record material comprising admixing a first component and a second component, the first component comprising 2,2-bis (4-hydroxyphenyl)-4-methylpentane and the second component comprising a mixture of dimethyl terephthalate and 1,2-diphenoxyethane, the first component being in a range of weight ratios from 1:2 to 2:1 relative the second component, said second component comprising from 50 to 70% dimethyl terephthalate, grinding the admixture to a particle size of less than 1 micron, and forming an aqueous slurry of the admixture.

In a preferred embodiment, the present invention is a thermally responsive record material comprising a support having provided thereon in substantially contiguous relationship an electron-donating dye precursor, an acidic developer material, a sensitizer, and a binder therefor, the sensitizer prepared by admixing 2,2-bis(4-hydroxyphenyl)-4-methylpentane and a substantially equal amount by weight of a mixture of dimethyl terephthalate and 1,2-diphenoxyethane, the mixture of dimethyl terephthalate and 1,2-diphenoxyethane comprising from 50 to 70% dimethyl terephthalate, and grinding the admixture to a particle size of less than 1 micron.

By grinding the sensitizer components together in the above-described weight ranges, a surprising improvement in image intensity and/or thermal response was detected. This improvement was not detectable when the components were ground separately or mixed in weight ranges outside the above-described weight ranges.

The record material according to the invention has a non-reversible image in that it is substantially non-reversible under the action of heat. The coating of the record material of the invention is basically a dewatered solid at ambient temperature.

The color-forming system of the record material of this invention includes chromogenic material (electron-donating dye precursor) in its substantially colorless or light-colored state and acidic developer material. The color-forming system relies upon melting, softening, or subliming one or more of the components to achieve reactive, color-producing contact with the chromogen.

The record material includes a substrate or support material which is generally in sheet form. For purposes of this invention, sheets can be referred to as support members and are understood to also mean webs, ribbons, tapes, belts, films, cards and the like. Sheets denote articles having two large surface dimensions and a comparatively small thickness dimension. The substrate or support material can be opaque, transparent or translucent and could, itself, be colored or not. The material can be fibrous including, for example, paper and filamentous synthetic materials. It can be a film including, for example, cellophane and synthetic polymeric sheets cast, extruded, or otherwise formed. The invention resides in the color-forming composition coated on the substrate. The kind or type of substrate material is not critical.

The components of the color-forming system are in substantially contiguous relationship, substantially homogeneously distributed throughout the coated layer material deposited on the substrate. The term substantially contiguous is understood to mean that the color-forming components are positioned in sufficient proximity such that upon melting, softening or subliming one or more of the components, a reactive color forming contact between the components is achieved. As is readily apparent to the person of ordinary skill in this art, these reactive components accordingly can be in the same coated layer or layers, or isolated or positioned in separate layers. In other words, one component can be positioned in the first layer, and reactive or sensitizer components positioned in a subsequent layer or layers. All such arrangements are understood herein as being substantially contiguous.

In manufacturing the record material, a coating composition is prepared which includes a fine dispersion of the components of the color-forming system, binder material preferably polymeric binder such as polyvinyl alcohol, surface active agents and other additives in an aqueous coating medium. The composition can additionally contain inert pigments, such as clay, talc, silicone dioxide, aluminum hydroxide, calcined kaolin clay and calcium carbonate; synthetic pigments, such as urea-formaldehyde resin pigments; natural waxes such as Carnauba wax; synthetic waxes; lubricants such as zinc stearate; wetting agents; defoamers, sensitizers and antioxidants and p-benzylbiphenyl. The sensitizer typically does not impact any image on its own but as a relatively low melt point solid acts as a solvent to facilitate reaction between the mark forming components of the color-forming system.

The color-forming system components are substantially insoluble in the dispersion vehicle (preferably water) and are ground to an individual average particle size of between about 1 micron to about 10 microns, preferably about 1–3 microns or less. The polymeric binder material is substantially vehicle soluble although latexes are also eligible in some instances. Preferred water soluble binders include polyvinyl alcohol, hydroxy ethylcellulose, methylcellulose, methyl-hydroxypropylcellulose, starch, modified starches, gelatin and the like. Eligible latex materials include polyacrylates, styrene-butadiene-rubber latexes, polyvinylacetates, polystyrene, and the like. The polymeric binder is used to protect the coated materials from brushing and handling forces occasioned by storage and use of thermal sheets. Binder should be present in an amount to afford such protection in an amount less than will interfere with achieving reactive contact between color-forming reactive materials.

Coating weights can effectively be about 3 to about 9 grams per square meter (gsm) and preferably about 5 to about 6 gsm. The practical amount of color-forming materials is controlled by economic considerations, functional parameters and desired handling characteristics of the coated sheets.

Eligible electron donating dye precursors are chromogenic compounds, such as the phthalide, leucauramine and fluoran compounds, for use in the color-forming and fluoran compounds, for use in the color-forming system are well known color-forming compounds. Examples of the compounds include Crystal Violet Lactone (3,3-bis(4-dimethylaminophenyl)-6-dimethylaminophthalide, U.S. Pat. No. RE. 23,024); phenyl-incol-, pyrrol-, and carbazol-substituted phthalides (for example in U.S. Pat. Nos. 3,491,111; 3,491,112; 3,491,116; 3,509,174); nitro-, amino-, amido-, sulfon amido-, aminobenzylidene-, halo-, anilino-substituted fluorans (for example, in U.S. Pat. Nos. 3,624,107; 3,627,787, 3,641,011; 3,642,828; 3,681,390); spirodipyrans (U.S. Pat No. 3,971,808); and pyridine and pyrazine compounds (for example, in U.S. Pat. Nos. 3,775,424 and 3,853,869). Other specifically eligible chromogenic compounds, not limiting the invention to any way, are: 3-diethylamino-6-methyl-7-anilino-fluoran (U.S. Pat. No. 3,681,390); 2-anilino-3-methyl-6-dibutylamino-fluoran (U.S. Pat. No. 4,510,513) also known as 3-dibutylamino-6-methyl-7-anilino-fluoran; 3-dibutylamino-7-(2-chloroanilino) fluoran; 3-(N-ethyl-N-tetrahydrofurfurylamino)-6-methyl-7-3,5,6-tris(dimethylamino) spiro [9H-fluorene-9,1', (3'H)-isobenzofuran]-3'-one; 7-(l-ethyl-2-methylindol-3-yl)-7-(4-diethylamino-2-ethoxyphenyl) -5,7-dihydrofuro[3,4-b] pyridin-5-one (U.S. Pat. No. 4,246,318); 3-diethylamino-7-(2-chloroanilino) fluoran (U.S. Pat. No. 3,920,510); 3-(N-methylcyclohexylamino)-6-methyl-7-anilinofluoran (U.S. Pat. No. 3,959,571); 7-(1-octyl-2-methylindol-3-yl) -7-(4-diethylamino-2-ethoxyphenyl) -5, 7-dihydrofuro[3,4-b] pyridin-5-one; 3-diethylamino-7,8-benzofluoran; 3,3-bis(1-ethyl-2-methylindo 1-3-yl) phthalide; 3-diethylamino-7-anilinofluoran; 3-diethylamino-7-benzylaminofluoran; 3,-phenyl-7-dibenzylamino-2,2'-spiro-di-[2H-1-benzopyran] and mixtures of any of the following.

Examples of eligible acidic developer material include the compounds listed in U.S. Pat. No. 3,539,375 as phenolic reactive material, particularly the monophenols and diphenols. Other eligible acidic developer material which can be used also include, without being considered as limiting, the following compounds:

4,4'-isopropylidinediphenol (Bisphenol A); p-hydroxybenzaldehyde; p-hydroxybenzophenone; p-hydroxypropiophenone; 2,4-dihydroxybenzophenone; 1,1-bis(4-hydroxyphenyl) cyclohexane; salicyanilide;

4-hydroxy-2-methylacetophenone; 2-acetylbenzoic acid; m-hydroxyacetanilide; p-hydroxyacetanilide; 2,4-dihydroxyacetophenone; 4-hydroxy-4,-methylbenzophenone; 4,4'-dihydroxybenzophenone; 2,2-bis(4-hydroxyphenyl)-4-methylpentane; benzyl 4-hydroxyphenyl ketone; 2,2-bis(4-hydroxyphenyl)-5-methylhexane; ethyl-4,4-bis(4-hydroxyphenyl)-pentanoate; isopropyl-4,4-bis(4-hydroxyphenyl) pentanoate; methyl -4,4-bis (4-hydroxyphenyl) pentanoate; alkyl-4,4-bis (4-hydroxyphenyl) pentanoate; 3,3-bis (4-hydroxyphenyl-pentane; 4,4-bis(4-hydroxyphenyl pentanoate; 3,3-bis (4-hydroxyphenyl)-pentane; 4,4-bis (4-hydroxyphenyl)-heptane; 2,2-bis (4-hydroxy-phenyl) butane; 2,2,-methylene-bis (4-ethyl-6-tertiarybutyl phenol); 4-hydroxy-coumarin; 7-hydroxy-4-methylcoumarin; 2,2,-methylene-bis(4-octylphenol); 4,4,-sulfonyldiphenol; 4,4'-thiobis (6-tertiarybutyl-m-cresol); methyl-p-hydroxybenzoate; n-propyl-p-hydroxybenzoate; benzyl-p-hydroxybenzoate. Preferred among these are the phenolic developer compounds. More preferred among the phenol compounds are 4,4,-isopropylindinediphenol, ethyl-4,4-bis (4-hydroxyphenyl)-pentanoate, n-propyl -4,4-bis (4-hydroxyphenyl) pentanoate, isopropyl -4, 4-bis (4-hydroxyphenyl) pentanoate, -methyl-4,4-bis(4-hydroxyphenyl) pentanoate, 2,2-bis (4-hydroxy-phenyl)-4-4-methylpentane, p-hydroxybenzophenone, 2,4-dihydroxybenzophenone, 1,1-bis (4-hydroxyphenyl) cyclohexane, and benzyl-p-hydroxybenzoate. Acid compounds of other kind and types are eligible.

Examples of eligible acidic developer compounds for use with the invention are phenolic novolak resins which are the product of reaction between, for example, formaldehyde and a phenol such as an alkylphenol, e.g., p-octylphenol, or other phenols such as p-phenylphenol, and the like; and acid mineral materials including colloidal silica, kaolin, bentonite, attapulgite, hallosyte, and the like. Some of the polymers and minerals do not melt but undergo color reaction on fusion of the chromogen.

Tables 1 and 2 and FIGS. 1, 2, 3 and 4 help illustrate the invention. In tables 1 and 2 the "Examples" illustrate the invention by comparison to the "Comp. Examples" or Comparative Examples.

Figure 2:
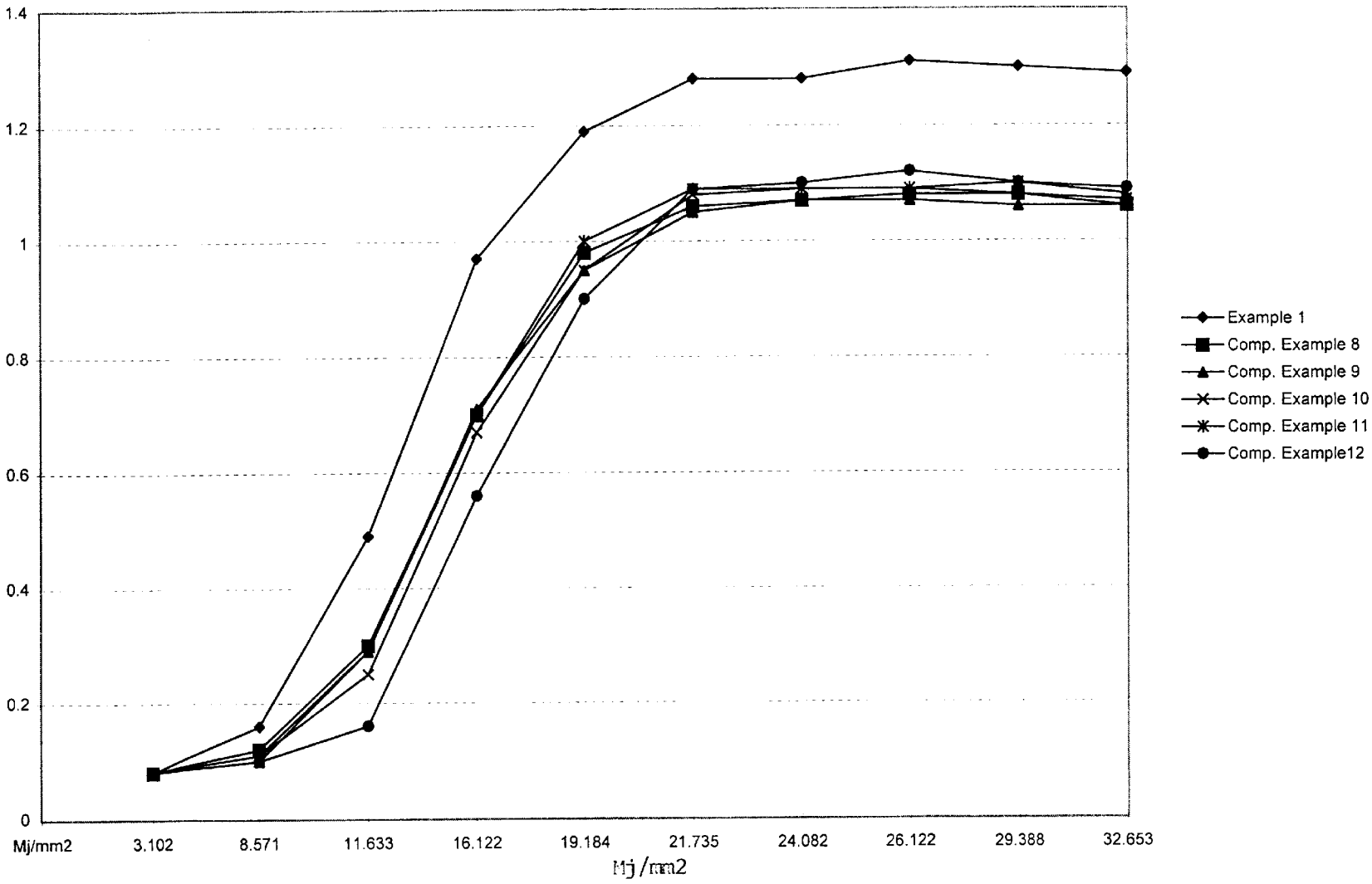
FIG. 2. illustrates the thermal response of the thermally responsive record material of the invention wherein components are ground together compared with comparative examples 8, 9, 10, 11 and 12 wherein the components are ground separately.

In this invention the various ingredients are ground together. The effect of grinding the ingredients together as compared to grinding; separately is illustrated in Table 1, the comparison of Example 1 verses Comp. Examples 2 through 12. In particular the intensity improvement of Example 1 verses identically constituted but separately ground Comp. Example 7 is noted. FIGS. 1 and 2 illustrate the comparisons visually.

In Table 2 the Examples and the Comp. Examples, all have ingredients ground together. The criticality of the ranges of the invention are illustrated.

Examples 1, 18 and 19 illustrate the invention. These examples are presented visually in FIGS. 3 and 4.

Figure 3:
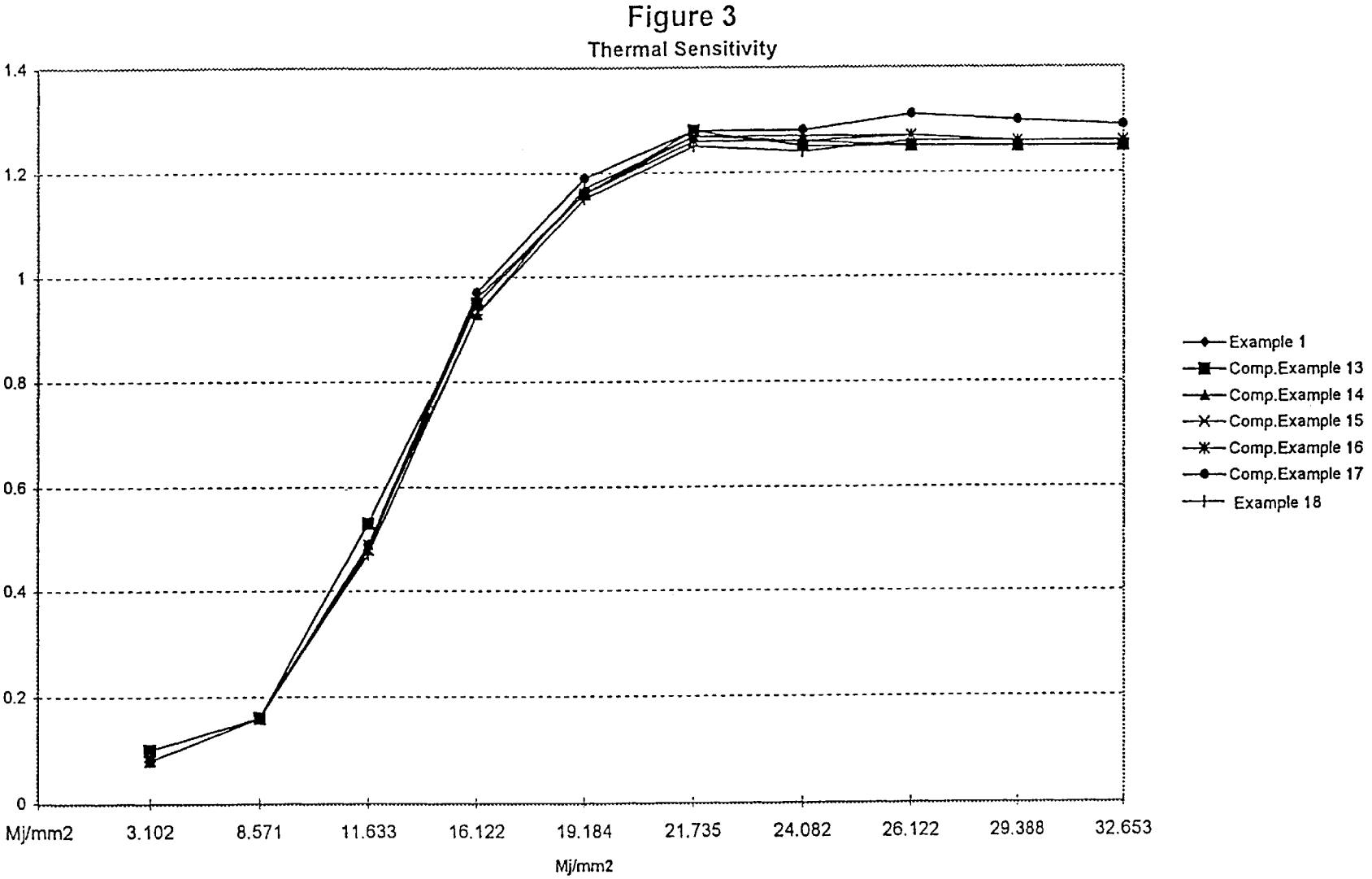
FIG. 3 illustrates the thermal response of thermally responsive record material according to the invention where components are ground together compared with comparative examples 13, 14, 15, 16 and 17.

FIG. 3 illustrates that by grinding the ingredients together improvements in sensitivity are achieved as the various graphed lines tend toward merger.

Figure 4:
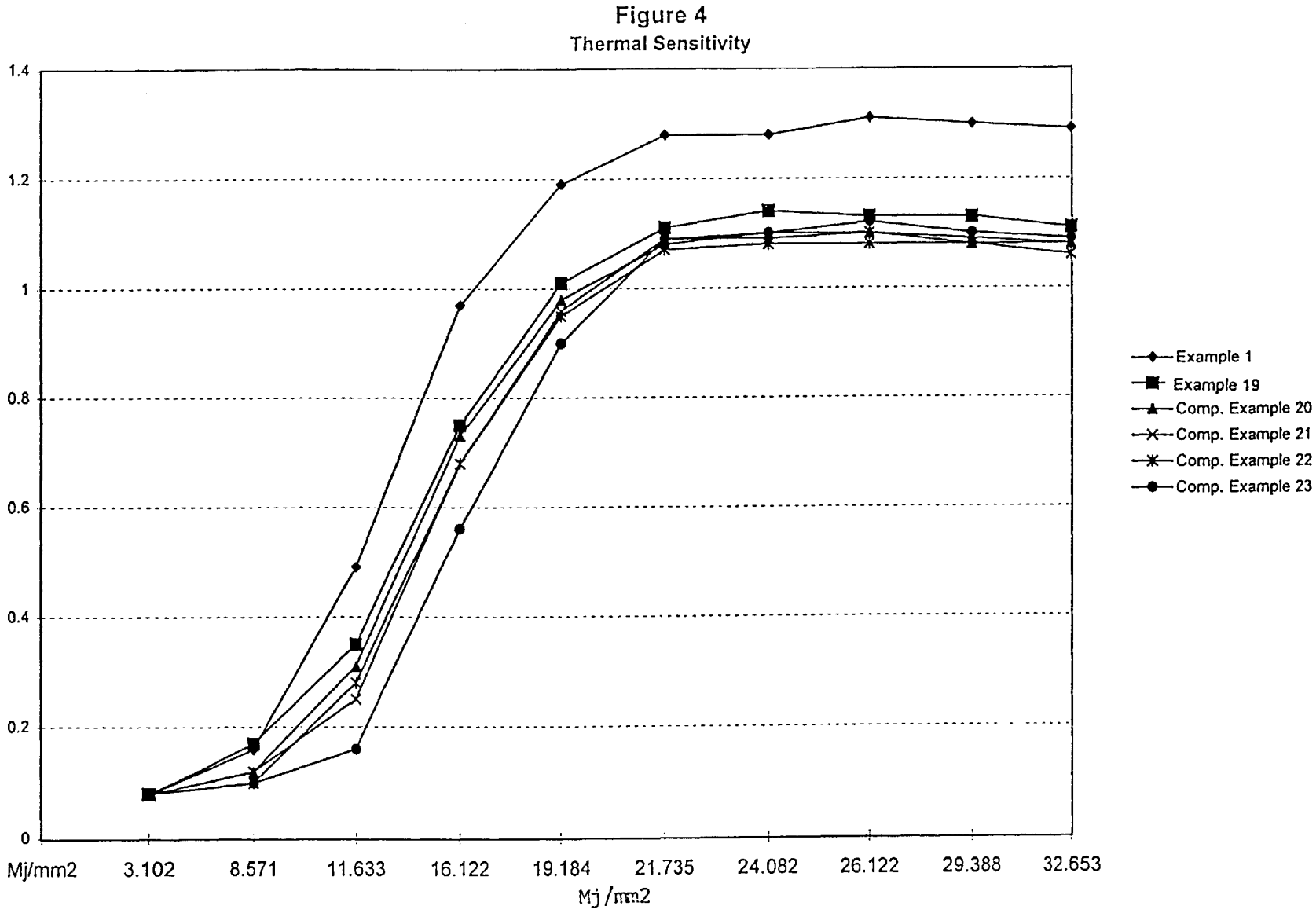
FIG. 4 illustrates the thermal response of thermally responsive record material according to the invention where components are ground together compared with comparative examples 20, 21 and 22. Examples 1, 18 and 19 illustrate the invention.

In FIG. 4 as the concentration of DMT exceeds about 70%, there is a noticeable drop in image density and speed of imaging.

In FIG. 3 as DMT concentration drops below about 50% and the DPE concentration predominates, the response curve of DPE is obtained. DPE today is a commercially used sensitizer. It is surprising and unexpected that from 50 to 70% of DPE can be replaced with the combination of the invention. An intense imaging paper is obtained.

TABLE 1

| | Example 1 Ground Together | Comp. Example 2 Ground Separately | Comp. Example 3 Ground Separately | Comp. Example 4 Ground Separately | Comp. Example 5 Ground Separately | Comp. Example 6 Ground Separately |
|---|---|---|---|---|---|---|
| Parts DPE/ DMT/AP5 | .5/5/1 | 1/0/1 | .9/.1/1 | .8/.2/1 | .7/.3/1 | .6/.4/1 |
| % DPE/DMT | 50%—50% | 100%–0% | 90%–10% | 80%–20% | 70%–30% | 60%–40% |
| Head Energy 3.102 (mj/mm$^2$) | 0.08 | 0.11 | 0.08 | 0.09 | 0.07 | 0.07 |
| Head Energy 8.571 (mj/mm$^2$) | 0.16 | 0.16 | 0.16 | 0.16 | 0.13 | 0.10 |
| Head Energy 11.633 (mj/mm$^2$) | 0.49 | 0.53 | 0.40 | 0.39 | 0.13 | 0.29 |
| Head Energy 16.122 (mj/mm$^2$) | 0.97 | 0.95 | 0.93 | 0.79 | 0.35 | 0.72 |
| Head Energy 19.184 (mj/mm$^2$) | 1.19 | 1.16 | 1.13 | 1.04 | 0.76 | 0.98 |
| Head Energy 21.735 (mj/mm$^2$) | 1.28 | 1.28 | 1.20 | 1.12 | 0.98 | 1.08 |
| Head Energy 24.082 (mj/mm$^2$) | 1.28 | 1.25 | 1.20 | 1.14 | 1.08 | 1.08 |
| Head Energy 26.122 (mj/mm$^2$) | 1.31 | 1.25 | 1.21 | 1.14 | 1.09 | 1.08 |
| Head Energy 29.388 (mj/mm$^2$) | 1.30 | 1.21 | 1.23 | 1.14 | 1.10 | 1.08 |
| Head Energy 32.653 (mj/mm$^2$) | 1.29 | 1.19 | 1.18 | 1.13 | 1.12 | 1.11 |

| | Comp. Example 7 Ground Separately | Comp. Example 8 Ground Separately | Comp. Example 9 Ground Separately | Comp. Example 10 Ground Separately | Comp. Example 11 Ground Separately | Comp. Example 12 Ground Separately |
|---|---|---|---|---|---|---|
| Parts DPE/ | .5/.5/1 | .4/.6/1 | .3/.7/1 | .2/.8/1 | .1/.9/1 | 0/1/1 |

TABLE 1-continued

| DMT/AP5 % DPE/DMT | 50%—50% | 40%–60% | 30%–70% | 20%–80% | 10%–90% | 100% |
|---|---|---|---|---|---|---|
| Head Energy 3.102 (mj/mm$^2$) | 0.07 | 0.08 | 0.08 | 0.08 | 0.08 | 0.08 |
| Head Energy 8.571 (mj/mm$^2$) | 0.12 | 0.12 | 0.10 | 0.11 | 0.11 | 0.10 |
| Head Energy 11.633 (mj/mm$^2$) | 0.33 | 0.30 | 0.29 | 0.25 | 0.29 | 0.16 |
| Head Energy 16.122 (mj/mm$^2$) | 0.71 | 0.70 | 0.71 | 0.67 | 0.70 | 0.56 |
| Head Energy 19.184 (mj/mm$^2$) | 0.98 | 0.98 | 0.95 | 0.95 | 1.00 | 0.90 |
| Head Energy 21.735 (mj/mm$^2$) | 1.05 | 1.06 | 1.05 | 1.08 | 1.09 | 1.09 |
| Head Energy 24.082 (mj/mm$^2$) | 1.05 | 1.07 | 1.07 | 1.09 | 1.09 | 1.10 |
| Head Energy 26.122 (mj/mm$^2$) | 1.05 | 1.08 | 1.07 | 1.09 | 1.09 | 1.12 |
| Head Energy 29.388 (mj/mm$^2$) | 1.05 | 1.08 | 1.06 | 1.08 | 1.10 | 1.10 |
| Head Energy 32.653 (mj/mm$^2$) | 1.07 | 1.06 | 1.06 | 1.07 | 1.08 | 1.09 |

TABLE 2

| | Example 1 Ground Together | Comp. Example 13 Ground Together | Comp. Example 14 Ground Together | Comp. Example 15 Ground Together | Comp. Example 16 Ground Together | Comp. Example 17 Ground Together |
|---|---|---|---|---|---|---|
| Parts DPE/ DMT/AP5 | .5/.5/1 | 1/0/1 | .9/.1/1 | .8/.2/1 | .7/.3/1 | .6/.4/1 |
| % DPE/DMT | 50%—50% | 100%–0% | 90%–10% | 80%–20% | 70%–30% | 60%–40% |
| Head Energy 3.102 (mj/mm$^2$) | 0.08 | 0.1 | 0.08 | 0.08 | 0.08 | 0.08 |
| Head Energy 8.571 (mj/mm$^2$) | 0.16 | 0.16 | 0.16 | 0.16 | 0.16 | 0.16 |
| Head Energy 11.633 (mj/mm$^2$) | 0.49 | 0.53 | 0.49 | 0.48 | 0.49 | 0.49 |
| Head Energy 16.122 (mj/mm$^2$) | 0.97 | 0.95 | 0.93 | 0.96 | 0.95 | 0.97 |
| Head Energy 19.184 (mj/mm$^2$) | 1.19 | 1.16 | 1.17 | 1.16 | 1.16 | 1.19 |
| Head Energy 21.735 (mj/mm$^2$) | 1.28 | 1.28 | 1.27 | 1.27 | 1.26 | 1.28 |
| Head Energy 24.082 (mj/mm$^2$) | 1.28 | 1.25 | 1.26 | 1.27 | 1.26 | 1.28 |
| Head Energy 26.122 (mj/mm$^2$) | 1.31 | 1.25 | 1.25 | 1.27 | 1.27 | 1.31 |
| Head Energy 29.388 (mj/mm$^2$) | 1.3 | 1.25 | 1.25 | 1.26 | 1.26 | 1.3 |
| Head Energy 32.653 (mj/mm$^2$) | 1.29 | 1.25 | 1.25 | 1.26 | 1.26 | 1.29 |

| | Example 18 Ground Together | Example 19 Ground Together | Comp. Example 20 Ground Together | Comp. Example 21 Ground Together | Comp. Example 22 Ground Together |
|---|---|---|---|---|---|
| Parts DPE/ DMT/AP5 | .4/.6/1 | .3/.7/1 | .2/.8/1 | .1/.9/1 | 0/1/1 |
| % DPE/DMT | 40%–60% | 30%–70% | 20%–80% | 10%–90% | 0%–100% |
| Head Energy 3.102 (mj/mm$^2$) | 0.08 | 0.08 | 0.08 | 0.08 | 0.08 |
| Head Energy 8.571 (mj/mm$^2$) | 0.17 | 0.12 | 0.12 | 0.1 | 0.1 |
| Head Energy 11.633 (mj/mm$^2$) | 0.35 | 0.31 | 0.25 | 0.28 | 0.16 |
| Head Energy 16.122 (mj/mm$^2$) | 0.75 | 0.73 | 0.68 | 0.68 | 0.56 |
| Head Energy 19.184 (mj/mm$^2$) | 1.01 | 0.98 | 0.96 | 0.95 | 0.9 |
| Head Energy 21.735 (mj/mm$^2$) | 1.11 | 1.08 | 1.09 | 1.07 | 1.09 |
| Head Energy 24.082 (mj/mm$^2$) | 1.14 | 1.1 | 1.09 | 1.08 | 1.1 |

TABLE 2-continued

| | | | | | |
|---|---|---|---|---|---|
| Head Energy 26.122 (mj/mm$^2$) | 1.13 | 1.1 | 1.1 | 1.08 | 1.12 |
| Head Energy 29.388 (mj/mm$^2$) | 1.13 | 1.08 | 1.09 | 1.08 | 1.1 |
| Head Energy 32.653 (mj/mm$^2$) | 1.11 | 1.08 | 1.08 | 1.06 | 1.09 |

Table 1 illustrates Example 1 of the invention wherein the components are ground together compared to comparative examples wherein the components are ground separately. Example 1 illustrates the invention. The thermal record material samples are imaged on an Atlantek imaging device. The imaged samples are then read with a MacBeth densitometer. The MacBeth image density values are graphed as thermal response curves in FIGS. 1, 2, 3 and 4.

Examples 1, 18 and 19 illustrate the invention. In FIGS. 1 and 2, in the comparative examples, the components are ground separately. In FIGS. 3 and 4, the components are ground together.

Examples 1, 18 and 19 surprisingly have faster and more intense image density.

The principles, preferred embodiments, and modes of operation of the present invention have been described in the foregoing specification. The invention which is construed as limited to the particular forms disclosed since these are to be regarded as illustrative rather than restrictive. Variations and changes can be made by those skilled in the art without departing from the spirit and scope of the invention.

What is claimed is:

1. A thermally responsive record material comprising a support having provided thereon in substantially contiguous relationship an electron donating dye precursor, an acidic developer material, a sensitizer, and a binder therefor, the sensitizer comprising at least two components, the first component comprising 2,2-bis(4-hydroxyphenyl)-4-methylpentane and the second component comprising a mixture of dimethyl terephthalate and 1,2-diphenoxyethane, said second component comprising from 50 to 70% dimethyl terephthalate by weight, the sensitizer prepared by admixing the first component and the second component and grinding the sensitizer to a particle size of less than 1 micron.

2. The thermally responsive record material according to claim 1 wherein the first component and second component are substantially equal by weight.

3. The thermally responsive record material according to claim 1 wherein the acidic developer material is a phenol compound.

4. The thermally responsive record material according to claim 3 wherein the acidic developer material is benzyl-p-hydroxybenzoate.

5. The thermally responsive record material according to claim 1 wherein the electron donating dye precursor is a flouran compound.

6. An improved thermally responsive record material of the type comprising a support having provided thereon in substantially contiguous relationship an electron donating dye precursor, an acidic developer material, and a binder therefor, wherein the improvement comprises including in addition a sensitizer prepared by prepared by admixing a first component and a second component and grinding the admixture to a particle size of less than 1 micron, the first component comprising 2,2-bis(4-hydroxyphenyl)-4-methylpentane and the second component comprising a mixture of dimethyl terephthalate and 1,2-diphenoxyethane, the first component being in a range of weight ratios from 1:2 to 2:1 relative the second component, said second component comprising from 50 to 70% dimethyl terephthalate by weight.

7. The improved thermally responsive record material according to claim 6 wherein the first component and second component are substantially equal by weight.

8. The thermally responsive record material according to claim 6 wherein the acidic developer material is a phenol compound.

9. The thermally responsive record material according to claim 8 wherein the acidic developer material is benzyl-p-hydroxybenzoate.

10. The thermally responsive record material according to claim 6 wherein the electron donating dye precursor is a flouran compound.

11. A process for forming an improved sensitizer for thermally responsive record material comprising admixing a first component and a second component, the first component comprising 2,2-bis(4-hydroxyphenyl)-4-methylpentane and the second component comprising a mixture of dimethyl terephthalate and 1,2-diphenoxyethane, said second component comprising from 50 to 70% dimethyl terephthalate by weight, grinding the admixture to a particle size of less than 1 micron, forming an aqueous slurry of the admixture, combining the admixture with a dye percursor and acidic developer to form a coating slurry and coating the slurry onto a substance.

* * * * *